United States Patent [19]

Dawson, Jr.

[11] Patent Number: 4,952,896

[45] Date of Patent: Aug. 28, 1990

[54] FILTER ASSEMBLY INSERTABLE INTO A SUBSTRATE

[75] Inventor: Andrew J. Dawson, Jr., Harrisburg, Pa.

[73] Assignee: AMP Incorporated, Harrisburg, Pa.

[21] Appl. No.: 265,083

[22] Filed: Oct. 31, 1988

[51] Int. Cl.[5] ..... H01P 13/648; H01R 13/66

[52] U.S. Cl. ..... 333/182; 333/185; 439/607; 439/620

[58] Field of Search ..... 333/182–185; 361/302, 328–330; 439/607–610, 620

[56] References Cited

U.S. PATENT DOCUMENTS

| | | | |
|---|---|---|---|
| 3,002,162 | 9/1961 | Garstang | 333/183 X |
| 3,435,387 | 3/1965 | Reinke et al. | 333/183 |
| 3,579,155 | 5/1971 | Tuchto | 333/183 |
| 3,597,711 | 8/1971 | Buckley | 333/183 |
| 4,144,509 | 3/1979 | Boutros | 333/181 |
| 4,262,268 | 4/1981 | Shimada et al. | 333/182 |
| 4,399,419 | 8/1983 | Dobrovolny | 333/12 |
| 4,458,220 | 7/1984 | Carter et al. | 333/183 X |
| 4,484,159 | 11/1984 | Whitley | 333/182 |
| 4,494,092 | 1/1985 | Griffin | 333/183 X |
| 4,559,506 | 12/1985 | Capek | 333/181 |

FOREIGN PATENT DOCUMENTS

| | | |
|---|---|---|
| 36746 | 12/1981 | European Pat. Off. . |
| 214492 | 8/1986 | European Pat. Off. . |
| 2557381 | 6/1985 | France . |

*Primary Examiner*—Eugene R. LaRoche
*Assistant Examiner*—Benny Lee
*Attorney, Agent, or Firm*—Katherine A. Nelson

[57] ABSTRACT

A filter assembly 40 for an electrical connector 94 includes a plurality of terminal subassemblies 42 having a terminal member 44 and a plurality of filter component members 52, 60, 68 mounted thereon. The subassemblies are disposed within respective apertures of a dielectric substrate member. Each terminal member has first and second connecting portions 46, 48 and extending intermediate filter receiving portion 50 therebetween. The components are mounted on terminal member 44 such that the first and second component members 52, 60 are electrically connected to respective first and second terminal connecting portions and the third member 68 is disposed therebetween. In the preferred embodiment terminal subassemblies 42 are disposed and secured in a respective substrate apertures such that at least the third filter component member 68 is entirely recessed within aperture 90 and the first and second filter component members 52, 60 extend partially outwardly from the substrate aperture and project above first and second major surfaces 78, 82 such that conductive side surfaces 56, 64 of first and second filter component members 52, 60 can be electrically engaged to and mechanically secured to ground means on the substrate member 76.

7 Claims, 3 Drawing Sheets

FILTER ASSEMBLY INSERTABLE INTO A SUBSTRATE

FIELD OF THE INVENTION

The invention relates to filter members and more particularly to filter assemblies having a planar member.

BACKGROUND OF THE INVENTION

Filters, particularly low pass filters, are used extensively in electrical circuits to suppress noise. For high impedance, high frequency circuits pi-network filters are generally used. The pi-network is comprised of a shunt capacitor at both ends and a series inductor between.

The elimination of high frequency noise is necessary for the transmission of signals through the input/output devices of microcomputers, for example. Both individual pi-network filters and composite pi-network filter assemblies have been used in connectors. Generally, the assemblies such as those disclosed in U.S. Pat. Nos. 4,262,268 and 4,494,092 have capacitor assemblies comprising a pair of dielectric plates having a plurality of openings formed therein for receiving individual terminals. The dielectric plates have a plurality of isolated electrodes formed on one of the opposite faces of the plates adjacent respective openings formed therein for receiving individual terminals and a common electrode formed on the other face of the dielectric plates to provide for ground return. The terminal members extend through one dielectric plate, a tubular or planar magnetic member interposed between the first dielectric plate and a second dielectric plate. The terminals are mechanically and electrically connected to the respective electrodes on each dielectric plate. The assembly also includes means for electrically connecting the common electrodes to an external circuit. Generally the means requires soldering or otherwise electrically connecting the respective common electrodes on the two dielectric plates to a grounding means in the shell of the housing in a two step operation. Generally the soldering of at least one of the electrodes on the dielectric plates is "a blind operation", that is the solder is put in place within the shell member before the component, the component thereby blocking view of the soldered connection.

U.S. Pat. Nos. 3,579,155 and 3,597,711 disclose filter sleeve construction for individual terminals. The filter member of the '155 patent is comprised of a plurality of innersleeve magnetic ferrite members surrounded by an outer ceramic sleeve member. The '711 patent discloses a filter assembly having a single inner core of a magnetic ferrite material and an outer core of a dielectric material. The filter members disclosed in the above two patents have a pi-network configuration. The diameter of the filter members and therefore the diameter of the sleeve members is limited by the design of the connector in which the filter member is used and in particular to the configuration on the mating faces of the connector. Since one sleeve or one layer is completely encased within another, the thickness of respective layers is relatively thin. Thin walled sleeve members are generally more fragile and more costly to manufacture than members having thicker walls. In addition, the concentric sleeve arrangement requires greater restriction of tolerances since for any given filter, there are at least two inner and two outer dimensions that must be controlled.

It is desirable, therefore, to provide a filter assembly having component members with thicker walls, while maintaining the center line mating configuration of the terminals to which the filters are mounted.

Additionally it is desirable to have a filter assembly that can be made in an automated manufacturing process and in a cost effective manner.

It is also desirable to have a means for providing a pi-network filter assembly for an electrical connector that can be electrically connected to ground means within a shell without the need for "a blind soldering operation".

SUMMARY OF THE INVENTION

Accordingly, it is an object of the present invention to provide filtering capabilities for an electrical connector wherein the mating configuration is retained.

It is a further object of the invention to provide a tubular filter construction comprised of a plurality of loose piece members having relatively thick walls.

It is an additional object of the invention to provide a filter subassembly having a plurality of loose piece tubular members, with a plurality of subassemblies disposed in a selective arrangement in a planar substrate.

It is also an object of the invention to provide pi-network filtering capability for an electrical connector that requires a minimum of space within the connector.

It is yet another object of the invention to provide a pi-network filter assembly for an electrical connector that can be electrically connected to ground means within a shell without the need for "a blind soldering operation".

Another object of the invention is to provide a method for completing the formation of a pi-network filter member by first providing a terminal portion with a pair of spaced apart capacitive elements proximate ends thereof and an inductive element therebetween with the capacitive elements each connected to the terminal at respective locations but are otherwise electrically isolated from each other, then disposing the terminal portion in an aperture of a dielectric substrate and completing the pi-network filter by electrically connecting capacitor outside surfaces by a continuous ground path means on surfaces of the dielectric substrate such as by plating, printed or etched circuitry.

It is another object of the invention to provide a filter assembly that can be manufactured in an automated process.

It is still another object of the invention to provide a filter assembly comprising an array of pi-network filter members disposed in a single substrate member.

Another object of the invention is to provide a pi-network filter assembly that can be disposed in an electrical connector as a unit and electrically connected to ground in a single step.

The present invention is directed to a filter assembly for an electrical connector comprising at least one terminal subassembly disposed and secured in an aperture of a dielectric substrate member having ground means thereon for grounding the subassembly. The terminal subassembly includes a terminal member and a plurality of filter component members mounted thereon. Each of the filter component members have opposing end faces and side surfaces and a terminal-receiving aperture extending therethrough between the end faces. The terminal members include opposed first and second connecting portions and an intermediate portion therebetween disposed within the filter component member apertures. The plurality of filter component members include first and second members being proximate and electrically connected to the first and second terminal connecting portions respectively and at least a third member disposed therebetween. The first and second members have conductive side surfaces for connection grounding means on the substrate. The first, second and at least third members have axial lengths $L_1$, $L_2$ and $L_3$ respectively. The dielectric substrate member has first and second major surfaces and peripheral side surfaces therearound and at least one terminal assembly receiving aperture extending therethrough. The dielectric substrate members includes ground means on the first and second major surfaces and further includes means for electrically interconnection between the ground means on respective substrate surfaces. The substrate member has a thickness T, which provides support for the filter components and further provides a means to locate the ground means on the respective surfaces proximate the conductive side surfaces of respective first and second members. The conductive side surfaces of the first and second filter component members are mechanically secured to and electrically engaged with the grounding means on the first and second major substrate surfaces respectively.

In the presently preferred embodiment, the filter assembly comprises a plurality of filter subassemblies disposed in the dielectric substrate member. The first and second filter component members are capacitors and the third component member is an inductor. Preferably the conductive material is disposed on the entire major surfaces of the substrate and at least a portion of the peripheral side surfaces. To facilitate electrical connection of the surfaces of the capacitors to the ground means on the substrate surfaces, T, the thickness of the substrate, is greater than $L_3$ and less than the sum of $L_1$ plus $L_2$ plus $L_3$. The plurality of terminal subassemblies are disposed and secured in respective substrate apertures such that respective ones of the third filter component members are entirely recessed within the substrate apertures and the corresponding first and second filter component members extend partially outwardly from the apertures and project above the first and second major substrate surfaces respectively. When the filter assembly is disposed in an electrical connector and the ground means of the substrate is electrically connected to ground means for the connector, a filter assembly is provided that is protective of the third filter component members, has a compact structure and does not require a transverse ground plane means.

The invention is further directed to a method for making the assembly in accordance with the invention.

The invention is also directed to a method for completing the formation of a pi-network filter member by the steps of first providing a terminal portion with a pair of spaced apart capacitive elements proximate ends thereof and an inductive element therebetween, each of the capacitive elements being electrically connected to the terminal at respective locations but otherwise electrically isolated from each other; disposing the terminal portion in an aperture of a dielectric substrate; and completing the pi-network filter by electrically connecting capacitor outside surfaces by a continuous ground path means on surfaces of the dielectric substrate such as by plating, printed or etched circuitry.

The invention itself, together with further objects and attendant advantages of the invention will be best understood by reference to the following detailed description, taken in conjunction with the accompanying drawings.

DETAILED DESCRIPTION OF THE DRAWINGS

Figure 1:
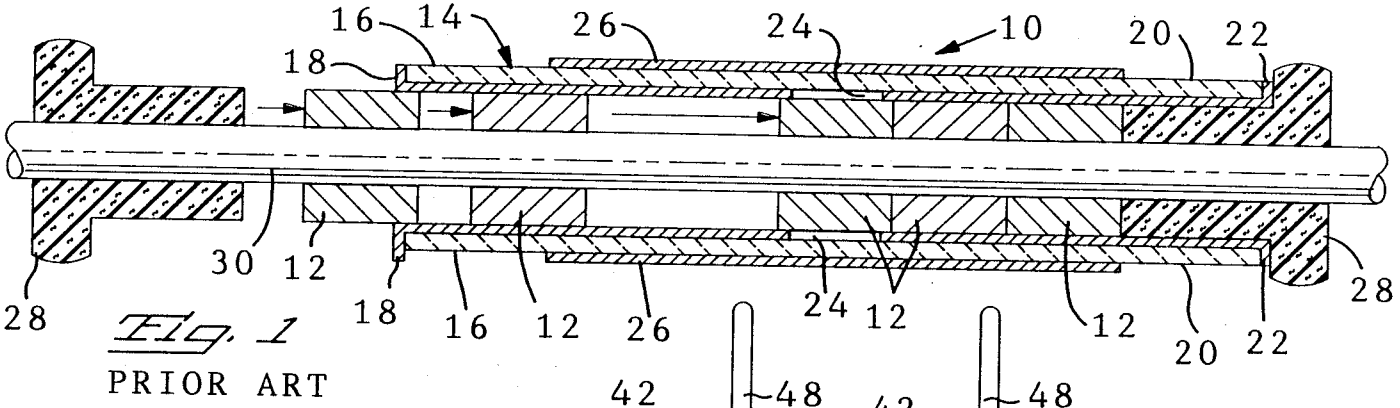
FIG. 1 PRIOR ART
FIG. 1 is a cross sectional view of a filter assembly of the prior art.

FIG. 1 shows a prior art filtered connector 10 having a plurality of tubular ferrite members 12 and a ceramic sleeve member 14 disposed on an electrical terminal member 30 (shown only in part). Ceramic sleeve member 14 includes first and second capacitor members 16, 20 respectively, having respective signal conductor portions 18, 22 separated by a gap 24 on an internal surface of the ceramic sleeve 14 and ground conductor 26 disposed on the outside of ceramic sleeve 14. Filter assembly is further comprised of conductive plug members 28, which retain ferrite members 12 within sleeve 14 and electrically connect respective signal conductors 18, 22 of capacitor member 16, 20 to the electrical terminal 30. This filter structure is disclosed in U.S. Pat. No. 3,579,155 and is representative of the loose piece type filter sleeve construction having at least one sleeve member within a sleeve and generally known as the lumped element filter. The filter assembly 10 is a pi-network filter.

Figure 2:
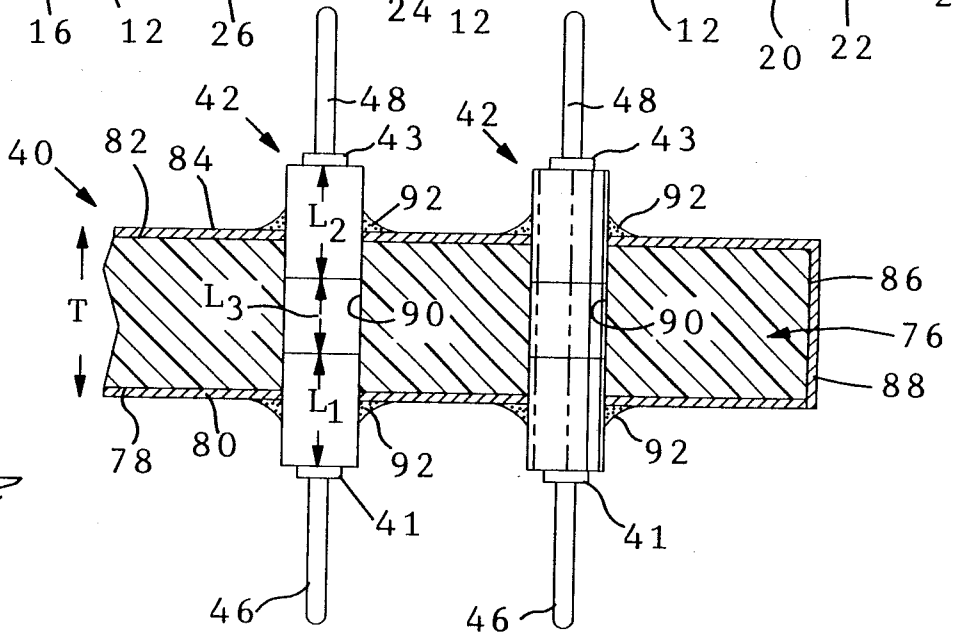
FIG. 2 is a perspective view of the filter assembly of the present invention comprising a substrate having an array of filter subassembly members.

Referring now to FIGS. 2 through 5, the filter assembly 40 of the present invention comprises at least one filter terminal subassembly 42 disposed in a dielectric substrate 76, substrate 76 including means thereon for grounding terminal subassembly 42, as best seen in FIG. 2. Filter assembly 40 is intended to be used in electrical connectors such as connector 94 shown in FIG. 7.

Figure 3:
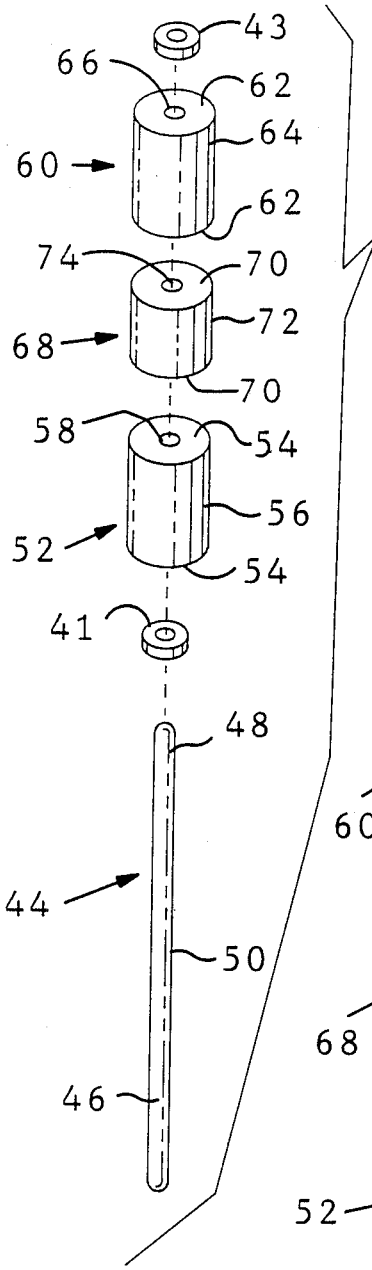
FIG. 3 is an exploded view of a filter subassembly of the present invention.
Figure 4:
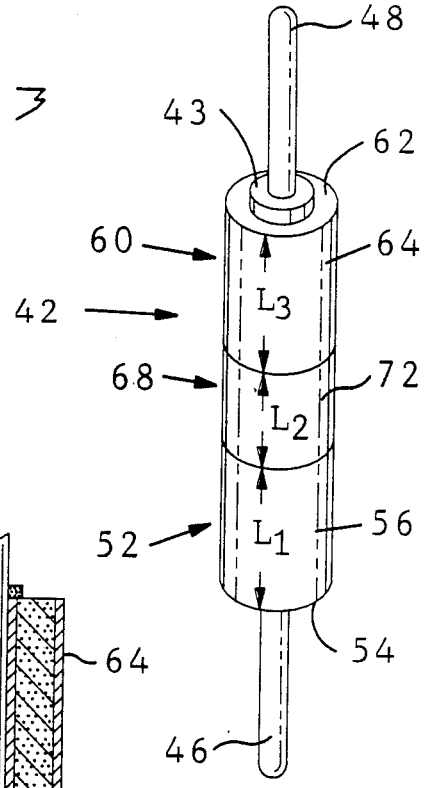
FIG. 4 is a prospective view of the assembled filter subassembly of FIG. 3.
Figure 5:
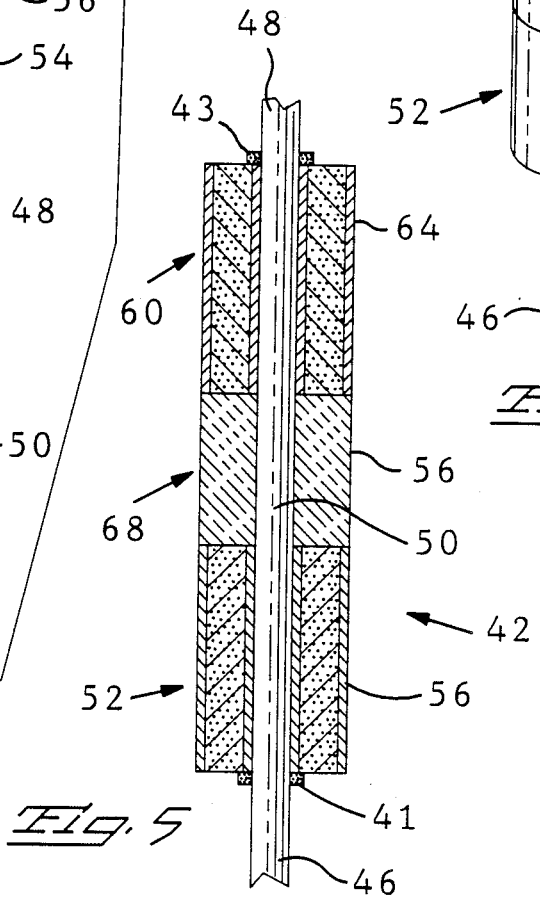
FIG. 5 is a fragmentary cross sectional view of the subassembly of FIG. 4.

Referring now to FIGS. 3 through 5, filter terminal subassembly 42 is comprised of a terminal member 44 and a plurality of filter component members 52, 60, 68 mounted thereon. Terminal member 44 includes opposed first and second connecting portion 46, 48 and an intermediate portion 50. In the embodiment shown, terminal member 44 is illustrated as a pin terminal. It is to be understood, however, that the first and second connecting portions 46, 48 of the terminal member 44 may take a number of different configurations, at least one of which is preferably dimensioned for having the filter component members disposed thereon.

Filter subassembly 42 further includes first and second filter component members 52, 60 and at least one third filter component member 68. First component 52 has opposed end surfaces 54, side surface 56 and a terminal receiving aperture 58 extending therethrough between end faces 54. Second component member 60 has opposed end surfaces 62, side surface 64 and aperture 66 extending therethrough between the end faces 62. As best seen in the cross section in FIG. 5, side surfaces 56 and 64 of first and second component members 52, 60 respectively have conductive material disposed on at least sections thereof for electrical connection to grounding means. First and second component members 52, 60 further include conductive material disposed along the internal surfaces of respective apertures 58, 66 for electrical connection to first and second connecting portions 46, 48 of terminal member 44. Third filter component 68 has opposed end surfaces 70, side surface 72 and terminal receiving aperture 74 extending between end faces 70 thereof. Preferably, side surface 72 and surfaces of aperture 74 are not plated. First, second and third component members 52, 60, 68 have axial lengths $L_1$, $L_2$ and $L_3$ respectively , as shown in FIGS. 2 and 4. In the presently preferred embodiment first and second component members are capacitors and the third component is a ferrite sleeve.

The assembled terminal subassembly 42 is shown in FIG. 4 wherein the first and second component members are mounted to intermediate portion 50 of said terminal member 44 proximate first and second connecting portions 46, 48 respectively and at least one third member 68 is disposed therebetween. In manufacturing terminal subassembly 42 the loose piece sleeve members are mounted to intermediate portion 50 of terminal member 44 by inserting one of the connecting portions 46, 48 through respective terminal receiving apertures 58, 74, 66 of respective first, third and second component members 52, 68, 60 respectively. First and second component members 46, 48 are soldered at 41, 43 to inner surfaces of first and second component members at respective ends of the assembly 42, as best seen in FIGS. 4 and 5.

The structure of substrate 76 is shown in FIG. 2. Substrate 76 is a relatively thick substrate member having a thickness designated T. Substrate 76 has first and second major surfaces 78, 82 having ground conductive portions 80, 84 respectively, disposed thereon and peripheral end surface 86. Substrate 76 further includes at least one and preferably a plurality of terminal subassembly receiving apertures 90 extending between major surfaces 78, 82. Substrate member 76 provides support for filter component members 52, 60, 68 and further provides a means to locate the ground means 80, 84 on the respective surfaces 78, 82 proximate the conductive side surfaces 56, 64 of respective first and second component members 52, 60. The conductive side surfaces of the first and second filter component members are mechanically secured to and electrically engaged with the grounding means on the first and second major substrate surfaces respectively as best seen in FIGS. 2 and 5. In the alternative embodiment 140 shown in FIG. 6, filter subassembly receiving apertures 190 are also covered with conductive material prior to insertion of terminal subassemblies 142.

In the preferred embodiment, as best seen in FIG. 2, the major surfaces 78, 82 and peripheral end surface 86 are covered with conductive layer 80, 84 and 88 respectively. Conductive end surfaces 88 provide electrical interconnection between conductive layers 80, 84 and further provide a conductive surface for electrical connection to ground means of an electrical connector. To facilitate electrical connection of the surfaces of the capacitors to the conductive layers 80, 84 or ground means on the substrate surfaces, it is preferred that T, the thickness of the substrate, be greater than $L_3$ and less than the sum of $L_1$ plus $L_2$ plus $L_3$. It is to be understood, however, that the invention is not limited to that configuration. The purpose of the substrate is to provide support for the filter components and to provide a means for electrically connecting ground circuits on the substrate surfaces to the outer conductive surfaces of the capacitor members and to complete the pi-network filter.

Figure 8:
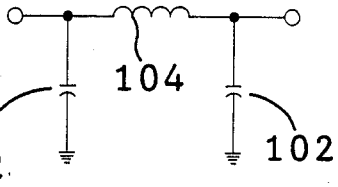
FIG. 8 is an electrical schematic drawing for the pi-filter network of the present invention.

In accordance with the preferred embodiment of the invention, the plurality of terminal subassemblies 42 are disposed and secured in respective substrate apertures 90 such that respective ones of the third filter component members 68 are entirely recessed within the substrate apertures 90 and the corresponding first and second filter component members 52, 60 extend partially outwardly from the apertures 90 and project above the first and second major substrate surfaces 78, 82 respectively as seen in FIG. 2. To ground the external conductive surfaces 56, 64 of respective first and second filter components 52, 60 solder or other conductive material is disposed at 92. The resulting filter assembly 40 of the preferred embodiment provides a plurality of pi-network filter subassemblies 42 comprising shunt capacitors 52, 60 having an inductor 68 therebetween disposed in the substrate 76. The schematic electrical diagram in shown in FIG. 8 wherein the capacitors are designated as 102 and the inductor as 104.

Figure 6:
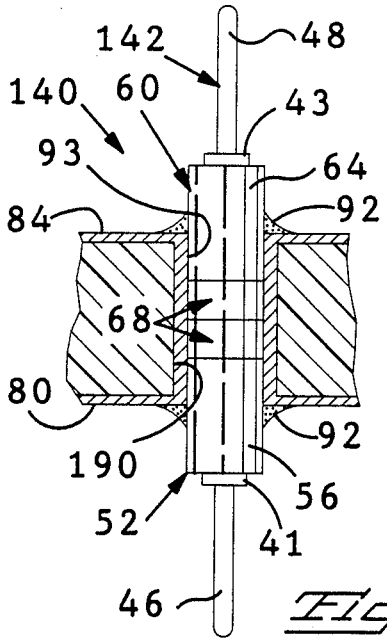
FIG. 6 is a perspective view of an alternative embodiment the subassembly of FIG. 4 disposed in a fragmentary portion of an alternative embodiment of the substrate.

FIG. 6 illustrates an alternative embodiment 140 of the filter assembly in which filter subassembly 142 includes a plurality of third filter component members 68. FIG. 6 further shows the alternative substrate embodiment 176 having plated apertures 93, which provide protection from cross talk as well as electrically interconnecting the conductive surfaces 80, 84.

Figure 7:
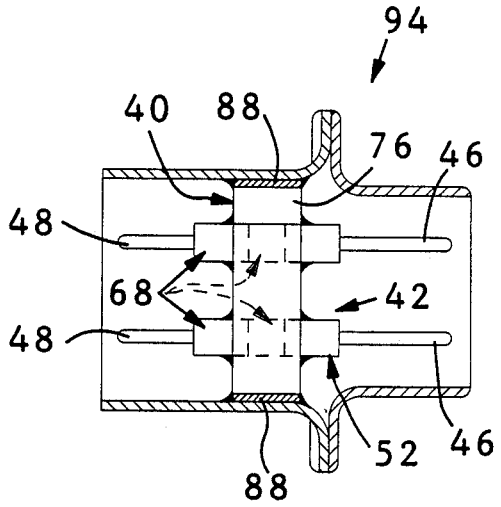
FIG. 7 is a cross sectional view of an electrical connector having the filter assembly of the present invention disposed therein.

FIG. 7 shows the filter assembly 40 disposed in a representative connector 94 having a conductive shell member 96 comprising ground means for the connector 94. As shown in FIG. 7, conductive surface 88 along the peripheral surface of substrate 76 is electrically engaged to the grounds means or shell 96 of connector 94 at 98. The present invention, therefore, provides a pi-network filter assembly 40 wherein the substrate 76 provides protection for the fragile ferrite member 68 and grounding means 80, 82 for the first and second capacitive members 52, 60 respectively. When at least one substrate edge 86 includes conductive surface portion 88, assembly 40 may be mounted in the connector 94 by soldering on only one of the conductive surfaces along the conductive peripheral edge 88, thus eliminating the need for "blind soldering". In the event there is no direct electrical interconnection between the conductive substrate surfaces 80, 84 within the filter assembly, the pi-network filters will be completed only upon electrically engaging and coupling both conductive surfaces with respective grounding means of a connector housing.

Figure 9:
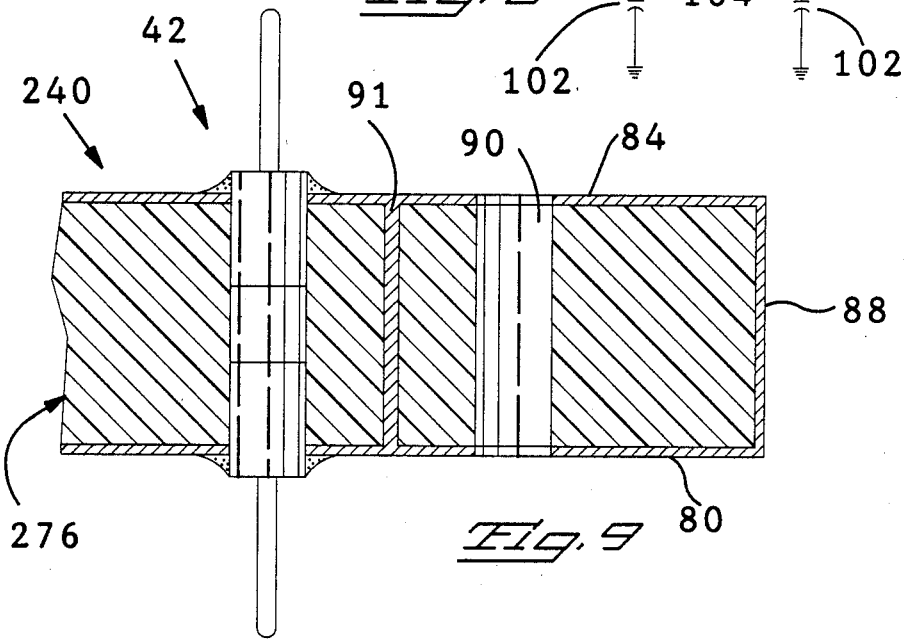
FIG. 9 is a perspective view of a fragmentary portion of a further alternative embodiment of the filter assembly of the present invention.

FIG. 9 shows a further alternative embodiment 240 of the filter assembly in which the thickness of substrate 276 is essentially equal to the sum of the lengths of the three filter component members. This substrate 176 provides greater stability and protection for the components. Substrate 276 also shows the plated through holes 91 that may be used to interconnect ground conductive surfaces 80, 84 in addition to or in place of peripheral conductive surface 88. Substrate 276 is mounted into a connector shell in the same manner as described above. Since there is electrical interconnection between the conductive substrate surfaces, only one conductive surface of substrate 276 need be soldered or otherwise electrically connected to ground means of a connector housing.

The filter terminal subassembly 42 of the present invention can be manufactured in an automated process by providing a fixture or other means to position the terminal member 44 in an upright position for receiving the filter components on intermediate portion 50 thereon, as best seen in FIGS. 2 and 5. A first solder ring or donut is first placed over terminal member 44, at 41, followed by first, third and second filter component members, 52, 60, 68 and a second solder ring or donut at 43.

Tubular inductor members are generally ferrite members, which are made from various formulations and are commercially available. The formulation selected depends upon the frequency band width required in each application. Tubular capacitor members are also readily available commercially. The particular capacitors selected will depend upon the specific electrical requirements of the application. A variety of dielectric substrate members also are commercially available. The substrate should be made from a material that is thermally stable under the conditions in which it is to be used. Preferably the substrate should be one that may be readily drilled or otherwise provided with apertures; one that is capable of being provided with conductive surfaces by means such as etching, plating or printing; and one having sufficient thickness to provide sufficient support for the filter component members and to provide ground connection to both capacitive members. In the preferred embodiment the substrate member is a polyimide. Other materials, as known in the art, are also usable.

After mounting the components on the terminal member, the assemblies are passed through an oven to melt the solder and electrically connect respective signal conductors 52, 60 inside the capacitive members to the intermediate portion 50 proximate first and second connecting portions 46, 48 of terminal 44. Substrate member 76 is prepared by drilling a plurality of through-holes 90 in a substrate having the desired thickness T. In the preferred embodiment, T is greater than $L_3$ but less than the sum of $L_1$ plus $L_2$ plus $L_3$. The surfaces of the substrate are then provided with conductive material by means known in the art, such as plating, etching or printing techniques. The preassembled terminal subassemblies 42 are inserted into the apertures 90 and secured therein by solder or other conductive material at 92. In assembling the alternative embodiment 140 shown in FIG. 6, filter subassembly receiving apertures 190 are also covered with conductive material prior to insertion of terminal subassemblies 142. The alternative embodiment provides a means for further shielding against crosstalk between signal conductors of a connector.

The filter assembly 40 of the present invention provides a more rugged tubular type structure for a pi-network filter assembly than is provided by disposing a sleeve within a sleeve, while maintaining the same center line configuration as the previous construction. Since loose piece components are mounted sequentially on the terminals, the walls of these components can be thicker than those of the prior art, with the diameter of the components closely approaching the diameter of subassembly receiving apertures 90. Furthermore, because the filter component members have relatively thick walls, in comparison to the components used in the sleeve within a sleeve filter member, the filter component members can be made within reasonable manufacturing tolerances and still be usable. The planar member provides protection for the ferrite member, which is magnetically coupled to the pin member. The filter assembly of the present invention further requires the use of only one substrate member to provide a grounding surface for two capacitors, unlike the connectors having two physically separate grounding plates as previously described. In addition the planar substrate member may be selectively loaded, that is only selected terminals need be provided with filter component members and the filtering capability of the components may be varied from terminal member to terminal member.

The present invention provides a much more rugged and compact structure than previously available for filtered connectors. The substrate further provides a means for directly electrically connecting the filter assembly to the ground means of a connector without the use of one or more additional ground plates. In addition, the present invention provides a one piece means for commoning two arrays of capacitive elements, each array being on opposed surfaces of a dielectric member and providing a conductive path to ground.

It is thought that the filter assembly of the present invention and many of its attendant advantages will be understood from the foregoing description. It will be apparent that various changes may be made in the form, construction, and arrangement of the parts thereof without departing from the spirit or scope of the invention or sacrificing all its material advantages. The form herein is merely a preferred or exemplary embodiment thereof.

I claim:

1. A filter assembly for an electrical connector comprising:

at least one terminal subassembly including a terminal member and a plurality of filter component members mounted thereon, each of said filter component members having opposing end faces and side surfaces and a terminal-receiving aperture extending therethrough between said end faces, each said terminal member including opposed first and second connecting portions and an intermediate portion extending therebetween, said filter component members being mounted on said intermediate portions of respective terminal members, said plurality of filter component members including first and second plurality of filter component members including first and second members being proximate and electrically connected to said first and second terminal connecting portion respectively, and said side surfaces of said first and second component members being conductive, said first and second component members having at least a third member disposed therebetween; and a dielectric substrate member having first and second major surfaces and at least one terminal assembly-receiving aperture extending therethrough, said dielectric substrate member including conductive material disposed on said first and second major surfaces;

said at least one terminal subassembly being disposed and secured in a corresponding one of said at least one substrate aperture such that said first and second filter component members are at least partially disposed in said respective aperture, said conductive side surfaces of said first and second filter component members being mechanically secured to and electrically engaged with said conductive material on said first and second major surfaces respectively; whereby a filter assembly is provided having a compact structure and an integral transverse ground means.

2. The filter assembly of claim 1 wherein said first, second and at least a third filter component members having axial lengths $L_1$, $L_2$, and $L_3$ respectively and said substrate member has a thickness T between respective major surfaces thereof wherein: T is greater than $L_3$ and less than the sum of $(L_1+L_2+L_3)$.

3. The filter assembly of claim 1 wherein said at least a third filter component member is entirely recessed therewithin and said first and second filter component members extend partially outwardly from said substrate aperture and project above said first and second major surfaces respectively.

4. The filter assembly of claim 1 wherein said conductive material extends along at least portions of peripheral edge surfaces of said substrate, thereby electrically connecting said conductive material on said substrate major surfaces.

5. The filter assembly of claim 1 wherein said first, second, and at least a third filter component members form a pi-network filter for a respective terminal member when said terminal subassembly is secured in said substrate member.

6. An electrical connector having the filter assembly of claim 1 disposed therein.

7. A method for completing the formation of a pi-network filter member comprising the steps of:

providing a terminal member having first and second connecting portions at opposed ends thereof and an intermediate portion extending therebetween;

providing said intermediate terminal portion with a pair of spaced apart capacitive elements proximate respective connecting portions and an inductive element therebetween, said capacitive elements including conductive outside surfaces;

electrically connecting the respective capacitive elements to the terminal member at respective locations, said capacitive elements otherwise being electrically isolated from each other;

disposing the intermediate terminal portion in a corresponding aperture of a dielectric substrate, said capacitive elements being proximate opposed major surfaces of said substrate; and electrically connecting conductive outside surfaces of said capacitive elements by a continuous ground path means disposed on opposed major surfaces of the dielectric substrate thereby completing the pi-network filter.

* * * * *